United States Patent [19]

Sugimura et al.

[11] 4,111,786

[45] Sep. 5, 1978

[54] PROCESS FOR LIQUEFYING COAL

[75] Inventors: Hidehiko Sugimura; Hisashi Murakami, both of Tokyo; Toshikatsu Ohtsubo; Kenji Fukuda, both of Omuta, all of Japan

[73] Assignee: Mitsui Coke Co., Ltd., Tokyo, Japan

[21] Appl. No.: 671,022

[22] Filed: Mar. 26, 1976

[30] Foreign Application Priority Data

Apr. 16, 1975 [JP] Japan ..... 45-332

[51] Int. Cl.[2] ..... C10G 1/04; C10B 55/00

[52] U.S. Cl. ..... 208/8; 201/8; 201/23

[58] Field of Search ..... 44/1 R; 208/45, 8; 201/5, 6, 8, 21-24

[56] References Cited

U.S. PATENT DOCUMENTS

| | | | |
|---|---|---|---|
| 1,512,577 | 10/1924 | Blythe | 201/23 X |
| 3,117,921 | 1/1964 | Gorin | 208/8 |
| 3,120,474 | 2/1964 | Gorin et al. | 201/24 X |
| 3,341,447 | 9/1967 | Bull et al. | 208/8 |
| 3,700,583 | 10/1972 | Salamony et al. | 208/8 |
| 3,849,287 | 11/1974 | Gleim et al. | 208/8 |
| 3,867,275 | 2/1975 | Gleim et al. | 208/8 |
| 3,870,621 | 3/1975 | Arnold et al. | 201/23 X |
| 3,892,654 | 7/1975 | Wright et al. | 208/8 |
| 3,966,585 | 6/1976 | Gray et al. | 208/8 |
| 4,054,504 | 10/1977 | Chervenak et al. | 208/10 |

OTHER PUBLICATIONS

Nelson; Petroleum Refinery Engineering 4th Edition, Chapters 5 and 6.

*Primary Examiner*—Morris O. Wolk
*Assistant Examiner*—Michael S. Marcus
*Attorney, Agent, or Firm*—Bacon & Thomas

[57] ABSTRACT

Process for manufacturing reformed coal which comprises the steps of (a) dispersing coal into a mixed oil which is comprised of a coal oil having a boiling point between about 150° C. and 500° C. and a petroleum oil having a boiling point higher than that of kerosene; (b) subjecting the coal and oil dispersion to hydrogenation conditions sufficient to depolymerize the coal; (c) separating a substantially liquified coal solution from the product of hydrogenation, and (d) distilling the liquified coal solution to recover a reformed coal. Preferably, a portion of the coal oil is recycled from the distillation stage and a portion of the hydrogen needed for hydrogenation is produced from light fractions from the distillation stage.

12 Claims, 1 Drawing Figure

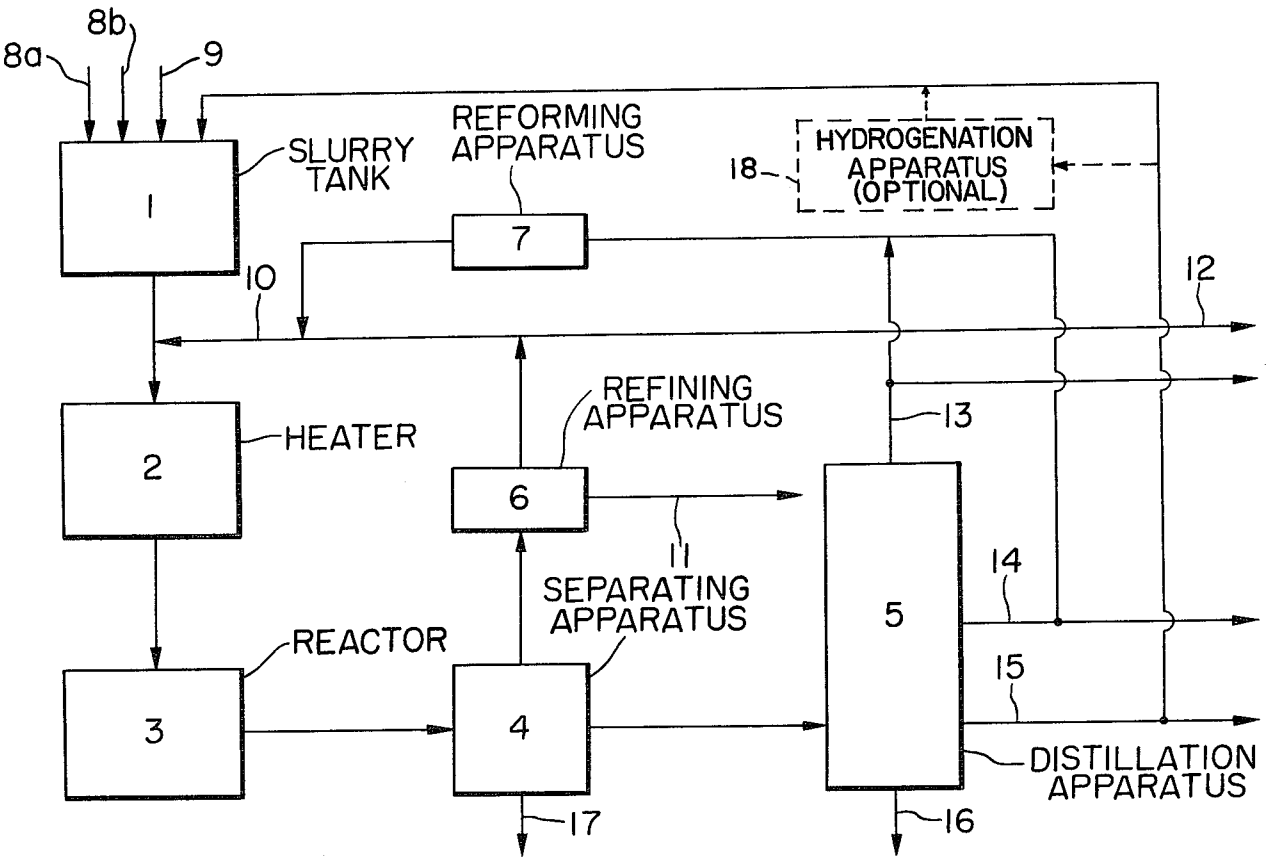
SLURRY TANK
REFORMING APPARATUS
HYDROGENATION APPARATUS (OPTIONAL)
HEATER
REFINING APPARATUS
REACTOR
SEPARATING APPARATUS
DISTILLATION APPARATUS
1
2
3
4
5
6
7
8a
8b
9
10
11
12
13
14
15
16
17
18

PROCESS FOR LIQUEFYING COAL

BACKGROUND OF THE INVENTION

The present invention relates to a process for manufacturing reformed coal.

Techniques for manufacturing coal have heretofore been described in the literature, for example, U.S. Pat. No. 3,341,447 in which coal mixed with coal oil as a solvent is heated under pressure with hydrogen, whereupon the organic substance in coal is depolymerized and solved in the coal oil, the minerals and unreacted coal residues contained in a liquidfied solvent are separated by a mechanical method, such as filtration, and a solvent refomed coal is produced. However, according to the technique described above, a large supply of coal oil is necessary. If all of this oil is supplied from the oil produced in this system, the coal must be subjected to severe conditions with the result that more organic substance is depolymerized. Unfortunately, in this case the productivity of reformed coal becomes lower. If coal oil is supplied from the outside, coal tar is best. But the quantity required and its price represent serious problems regarding the feasibility of the process. Moreover, the foregoing demands a large amount of hydrogen, and a supply thereof is another very important problem technically and economically.

On the other hand, it has also been proposed to use as the solvent the aromatic-rich substance which is made from heat treatment of petroleum oil, and in this case hydrogen is not used. (Joural of Japan Petroleum Institute, Vol.117, No.10 (1974). But, according to this technique another serious problem remains, namely, any organic sulphur and other impurities in coal and/or the solvent are brought into the product because no hydrogenation step is used.

In addition, it has hitherto been an obvious fact that coal oil which is rich in aromatic substance and petroleum oil which is rich in aliphatic substance are not thought of as being compatible with each other.

SUMMARY OF THE INVENTION

It is therefore an object of the present invention to provide a process for producing a useful and excellent reformed coal with lower ash and lower sulphur content.

A further object is to provide an improved process for producing reformed coal safely and in good yield by using petroleum oil for a part of the solvent as a dispersing agent of coal.

Another object is to provide a process for producing reformed coal economically by using the hydrogen produced in the manufacturing system instead of from outside.

In accomplishing the foregoing objects, applicants have provided in accordance with the present invention a process for manufacturing reformed coal which comprises the steps of (a) dispersing coal into a mixed oil which is comprised of a coal oil having a boiling point between about 150° C. and 500° C. and a petroleum oil having a boiling point higher than that of kerosene; (b) subjecting the coal and oil dispersion to hydrogeneration conditions sufficient to depolymerize the coal; (c) separating a substantially liquified coal solution from the product of hydrogenation; and (d) distilling the liquified coal to recover a reformed coal.

Preferably, the process also includes the steps of recovering from the distillation a solvent having a boiling point higher than about 150° C. and recycling this solvent to the dispersing step as at least part of the coal oil.

In accordance with another preferred aspect of the invention, the process also includes the steps of recovering hydrocarbon components boiling at a temperature less than about 150° C. from the distillation step, subjecting these components to reforming conditions to produce hydrogen, and supplying this hydrogen as at least part of the hydrogen required for the above-mentioned hydrogenation step.

Other objects, features and advantages of the invention will becomes apparent from the detailed description of preferred embodiments which follows, when considered in light of the accompanying sheet of drawing.

BRIEF SUMMARY OF THE DRAWING

The attached sheet of drawing represents a schematic flow diagram for a continuous process in accordance with the present invention.

DETAILED DESCRIPTION OF SOME PREFERRED EMBODIMENTS

More particularly, the present invention is charaterized by using as a solvent a mixed oil which is made from coal oil and petroleum oil or, especially a mixed oil which is made from petroleum oil and the oil produced from a system for manufacturing reformed coal. This invention is also characterized by using as hydrogen for the hydrogenation step mainly the hydrogen produced from a refining apparatus and/or reforming apparatus of the system hereof. The refining and reforming steps are carried out in a conventional manner. For example, the refining process represents the Stretford sulphur removing process (disclosed in Hydrocarbon Processing, Apr., page 104, 1975) and the reforming process represents the ICI process (disclosed in Hydrocarbon Processing, Nov., page 161, 1975) or the Topsoe process (disclosed in Hydrocarbon Processing, Nov., page 111, 1975).

For the liquification of coal by hydrogenolytic decomposition, the mixed oil which is made from coal oil and petroleum oil or the mixed oil which is made from petroleum oil and the oil produced from this manufacturing system is used. Coal is dispersed into the mixed oil described above and the resulting slurry is introduced into a reactor.

In the reactor, the slurry is liquified by depolymerization of the coal, and this is accelerated by a higher temperature and a higher pressure of hydrogen. Any undissolved solids in the solvent are separated by the application of filtration, the filtrate is then distilled and a reformed coal of high grade is obtained.

Coal described above represents bituminous coal, sub-bituminous coal, brown coal, or lignite; the petroleum oil represents the petroleum oil having a boiling point higher than that of kerosene; and coal oil represents the oil having a boiling point of between 140° C. and 500° C. produced from coal. The ratio of coal oil to petroleum oil in the mixed oils of the invention is between about 10:1 and 1:1, preferably, 10:1 and 5:1 on a weight basis.

Coal in this invention is used in the form of comminuted particles preferably of a size less than about 28 mesh or crushed particles, preferably of a size between about 2 mm and 100 mm size. In the case of using comminuted particles, coal is dispersed easily in the mixed oil, and the reaction rate of hydrogenolytic decomposition is higher. On the other hand, in the case of using crushed particles, it is not necessary to employ any special and expensive comminution apparatus, and in addition, separation of solids from the solvent is made easier. The coal is added to the mixed oil composition in a ratio of about 1:1 to 1:6 preferably 1:1.2 to 1:3 (Coal: mixed oil on a weight basis).

The heavy oil produced during the distillation step in this system can be used to prepare the mixed oil. The heavy oil can be used just as it is produced or it may be first subjected to hydrogenation which is effected under the condition of a temperature of 250° C.–350° C and a hydrogen pressure of 200 kg/cm$^2$– 350 kg/cm$^2$ in the presence of a conventional catalyser such as Ni, Pt and so on.

Referring now to the drawing, in accordance with this invention, coal is dispersed into the mixed solvent in a slurry tank 1, the mixed solvent being made from petroleum oil and coal oil, preferably coal tar oil having a boiling point of between 150° C. and 500° C. The coal-solvent dispersion is introduced into a reactor 3 through a heater 2, and then the content of a reactor is heated to a temperature of between about 350° C. and 500° C. and subjected to a hydrogen pressure of between about 3 kg/cm$^2$G and 150 kg/cm$^2$G preferably 50 kg/cm$^2$G and 100 kg/cm$^2$. The coal is thereby liquified by hydrogenolytic decomposition. Hydrogen and/or gas containing hydrogen is supplied to the reactor through an inlet 10. After the dehydrogenation step, the undissolved solid in the liquified solution is easily separated from the solution in a separating apparatus 4, just as in case of using coal oil alone for the solvent.

The liquified solution separated from the residues is introduced into a distillation apparatus 5, and three separate fractions, namely a gaseous, a light-and a heavy-hydrocarbon fraction, are recovered. Solvent reformed coal having a low ash and low sulphur content is recovered as the bottom residue from 16. Also in case where mixed oil made from the oil having a boiling point higher than 150° C. produced from the distillation process 5 and petroleum oil is used as the solvent, reformed coal with suitable properties is obtained.

In the process of this invention, the petroleum oil exposed to the conditions of hydrogenolytic decomposition is changed through thermal decomposition and/or polymerization to an oil rich in aromatic substance by the catalytic action of mineral substances in the coal and it becomes the solvent for depolymerizing coal. The active hydrogen produced by thermal decomposition in this invention promotes depolymerization of the coal. A part of the gaseous and light hydrocarbon (13 and 14) produced in large amounts by the process of this invention is reformed to hydrogen by a steam reforming process 7 and the hydrogen hereof is used for the hydrogenation reaction. That is to say, this invention can solve the problem of supplying the solvent by means of using petroleum oil which is available in sufficient supply. In addition, the process of this invention has the advantage that the hydrogen which is necessary for the reaction system can be supplied by the hydrogen produced in the system itself.

Moreover, according to the present invention, organic sulphur, organic oxygen and organic nitrogen are removed by a conventional process because they change to $H_2S$, $H_2O$, $NH_3$ in this process, and mineral substances in the coal are removed as residues by conventional separation. Also, metallic substances such as V, Ni etc. in petroleum oil are absorbed by the insoluble residues and are removed from the products. Consequently, in spite of using coal, coal oil and petroleum oil, all of which have significant impurities, a reformed coal product with desirable properties is manufactured.

Dryed and crushed particles of coal are dispersed via inlet 9 into the mixed oil in slurry tank 1 which is made from the oil 15 recycled from the distillation apparatus 5 and petroleum oil introduced through inlet **8*b*. An optional inlet 8*a* is provided for an additional source of coal oil. The slurried oil with hydrogen is introduced to a reactor 3 through a heater 2 and is then subjected to decomposition at a temperature in the range of about 350° C. to 500° C. and at a hydrogen pressure of from about 3 to 150 kg/cm$^2$G for a period of from about 10 to 120 minutes. Coal solution thus produced is introduced into a separating apparatus 4 wherein the gas, liquid and solid phases are separated. Solid is discharged to the outside of the system via outlet 17. The liquid is introduced into distilling apparatus 5, and a reformed coal 16 is produced from the bottom of the apparatus by distilling gaseous hydrocarbon 13, light oil 14 and heavy oil 15. Heavy oil is returned to slurry tank 1 as a recycled oil. From the distillation a solvent having a boiling point higher than about 150° C. can be recovered and recycled into the dispersing step. Optionally said solvent is hydrogenated in a hydrogenation apparatus 18** before recycling it.

A part of gaseous hydrocarbon and light oil from distillating apparatus 5 is introduced into a reforming apparatus 7 as starting material for the production of hydrogen and the remainder is discharged. The hydrogen from reforming apparatus 7 is used as all or part of the hydrogen for the hydrogenation reaction in the process of this invention. Also, gas separated by separating apparatus 4 is introduced into refining apparatus 6, in which acid gas is eliminated through outlet 11. A part of the gas from refining apparatus (6) is used as recycled hydrogen gas and the other part is discharged through off gas outlet 12.

For the purpose of further elucidating the present invention, a description will now be given here below in terms of illustrative examples, which are not to be considered as limiting the invention. In these examples, fuel oil A, fuel oil B and fuel oil C are defined according to Japanese Industrial Standard (K 2205 - 1960).

EXAMPLE 1

100 gr of comminuted coal particles of less than about 28 mesh (sold under the trade name Miike 62 Fun) are slurried in a mixed oil comprised of 210 gr. coal oil (bp 180° C.–350° C.) and 90 gr. petroleum oil (fuel oil A) in a 1 liter autoclave fitted with an agitator, and then 4 gr. hydrogen is introduced into the autoclave up to a hydrogen-pressure of 60 kg/cm$^2$. The contents of the autoclave are heated to 410° C. by a heater with agitation and kept at the same temperature for 60 minutes.

After cooling, the contents are discharged, the volume and components of the gas phase are measured, the minerals and unreacted coal are separated from the liquid phase by a filtration, and the filtrate is distilled at a pressure of 10 mmHg abs. and at a temperature of 230° C. in a vacuum distillation apparatus. 95 gr. of reformed coal are obtained. The yield of product, and the composition of the reformed coal and of the gas are shown in the following table.

TABLE I

| | Content of |
|---|---|

TABLE I-continued

| Yield of Product (gr) | | | | | Impurities in the Reformed Coal (%) | |
|---|---|---|---|---|---|---|
| Gas | Light Oil | Heavy Oil | Reformed Coal | Residue | Ash | Sulphur |
| 6 | 34 | 234 | 95 | 35 | <0.1 | 0.6 |

| Components of the Gas (Vol. %) | | | | | | | | |
|---|---|---|---|---|---|---|---|---|
| $Co_2$ | CnHm | $O_2$ | CO | $C_2H_6$ | $CH_4$ | $N_2$ | $H_2S$ | $H_2$ |
| 0.3 | 0.3 | 0 | 0.6 | 1.0 | 9.4 | 0.7 | 1.2 | 86.5 |

EXAMPLE 2

100 gr of comminuted coal particles of about 28 mesh and below (sold under the trade name Miike 62 Fun) are slurried in a mixed oil comprised of 210 gr. coal oil (bp 180° C.-350° C.) and 90 gr. petroleum oil (fuel oil B) in a 1 l autoclave fitted with an agitator, and 4 gr hydrogen is then introduced into the autoclave to produce a pressure of 60 kg/cm$^2$. The contents of the autoclave are heated to 410° C. by a heater with agitation and kept at the same temperature for 60 minutes. After cooling, the contents are discharged, the volume and components of the gas produced are measured, the liquified matter is separated from mineral and unreacted residue by a filtration, and the liquid fraction is then distilled at a pressure of 10 mmHg abs. and a temperature of 230° C. in a vacuum distillation apparatus. Gaseous hydrocarbon, light oil and heavy oil are recovered, and 108 gr of reformed coal is obtained. The yield of product, the composition of the reformed coal and of the gas are shown in the table below.

TABLE II

| Yield of Product (gr) | | | | | Content of Impurities in the Reformed Coal (%) | |
|---|---|---|---|---|---|---|
| Gas | Light Oil | Heavy Oil | Reformed Coal | Residue | Ash | Sulphur |
| 6 | 25 | 225 | 108 | 40 | <0.1 | 0.7 |

| Components of the Gas (Vol.%) | | | | | | | | |
|---|---|---|---|---|---|---|---|---|
| $CO_2$ | CnHm | $O_2$ | CO | $C_2H_6$ | $CH_4$ | $N_2$ | $H_2S$ | $H_2$ |
| 0.2 | 0.1 | 0 | 1.2 | 1.7 | 7.9 | 0.5 | 1.5 | 86.9 |

EXAMPLE 3

100 gr of comminuted coal particles of about 28 mesh and below (Miike 62 Fun) are slurried in a mixed oil comprised of 210 gr. coal oil (bp 180° C.-350° C.) and 90 gr. petroleum oil (fuel oil C) in a 1 l autoclave with an agitator. 4 gr. hydrogen is introduced into the autoclave to produce a pressure of 60 Kg/cm$^2$.

The contents of the autoclave are heated to 410° C. by a heater with agitation and kept at the same temperature for 60 minutes. After cooling, the contents are discharged, the volume and the components of the gas produced are measured, the liquified matter is separated from minerals and unreacted residue by a filtration and the liquid phase is distilled at a pressure of 10 mmHg abs. and at a temperature of 230° C. in a vacuum distillation apparatus.

Gaseous hydrocarbon, light oil and heavy oil are recovered and 135 gr. of reformed coal is obtained. The yield of the product, the composition of the reformed coal and of the gas are shown in the table below.

TABLE III

TABLE III-continued

| Yields of Product (gr.) | | | | | Impurities in the Reformed Coal (%) | |
|---|---|---|---|---|---|---|
| Gas | Light Oil | Heavy Oil | Reformed Coal | Residue | Ash | Sulphur |
| 5 | 16 | 10 | 135 | 3 | <0.1 | 0.9 |

| Components of the GAS (Vol. %) | | | | | | | | |
|---|---|---|---|---|---|---|---|---|
| $CO_2$ | CnHm | $O_2$ | CO | $C_2H_6$ | $CH_4$ | $N_2$ | $H_2S$ | $H_2$ |
| 0.3 | 0.1 | 0 | 0.7 | 1.3 | 9.0 | 0.1 | 1.4 | 87.1 |

EXAMPLE 4

100 gr of comminuted coal particles of about 28 mesh and below (Miike 62 Fun) are slurried in a mixed oil comprised of 150 gr. coal oil (bp. 180° C.-350° C.) and 150 gr. petroleum oil (fuel Oil A) in a 1 l autoclave with an agitator. 4 gr. hydrogen is introduced into the autoclave to produce a pressure of 60 Kg/cm$^2$. The contents of the autoclave are heated to 410° C. by a heater with agitation and kept at the same temperature for 60 minutes. After cooling, the contents are discharged, the volume and the components of the gas produced are measured, the liquified matter is separated from minerals and unreacted residue by filtration and the liquid phase is distilled at a pressure of 10 mmHg abs. and a temperature of 230° C. in a vacuum distillation apparatus. Gaseous hydrocarbon, light oil and heavy oil are recovered and 56 gr. of reformed coal is obtained. The yield of product, the composition of the reformed coal and of the gas are shown in the table below.

TABLE IV

| Yield of Product (gr.) | | | | | Content of Impurities in the Reformed Coal (%) | |
|---|---|---|---|---|---|---|
| Gas | Light Oil | Heavy Oil | Reformed Coal | Residue | Ash | Sulphur |
| 5 | 49 | 250 | 56 | 44 | <0.1 | 0.4 |

| Components of the Gas (Vol.%) | | | | | | | | |
|---|---|---|---|---|---|---|---|---|
| $CO_2$ | CnHm | $O_2$ | CO | $C_2H_6$ | $CH_4$ | $N_2$ | $H_2S$ | $H_2$ |
| 0.2 | 0.2 | 0 | 0.3 | 1.2 | 7.4 | 0.2 | 1.2 | 89.3 |

EXAMPLE 5

100 gr. of comminuted coal particles of about 28 mesh and below (Miike 62 Fun) are slurried in a mixed oil comprised of 150 gr. coal oil (bp. 180° C.-350° C.) and 150 gr. petroleum oil (fuel oil C) in a 1 l autoclave fitted with an agitator, into which is introduced 4 gr. hydrogen to produce a pressure of 60 kg/cm$^2$. The contents of the autoclave are heated to 410° C. by a heater with agitation and kept at the same temperature for 60 minutes. After cooling, the contents are discharged, the volume and components of the gas produced are measured, the liquified matter is separated from minerals and unreacted residue by filtration and the liquid phase is distilled at a pressure of 10 mmHg abs. and a temperature of 230° C. in a vacuum distillation apparatus. Gaseous hydrocarbon, light oil and heavy oil is recovered, and 163 gr. of reformed coal is obtained. The yield of product, the composition of the reformed coal and of the gas are shown in the table below.

TABLE V

| Yield of Product (gr.) | Content of Impurities in the Reformed Coal (%) |
|---|---|

TABLE V-continued

| Gas | Light Oil | Heavy Oil | Reformed Coal | Residue | Ash | Sulphur |
|---|---|---|---|---|---|---|
| 6 | 25 | 166 | 163 | 44 | <0.1 | 0.9 |

| Components of the Gas (Vol.%) | | | | | | | | |
|---|---|---|---|---|---|---|---|---|
| $CO_2$ | CnHm | $O_2$ | CO | $C_2H_6$ | $CH_4$ | $N_2$ | $H_2S$ | $H_2$ |
| 0.3 | 0.3 | 0 | 0.6 | 1.4 | 10.7 | 0.4 | 1.5 | 84.9 |

EXAMPLE 6

100 gr. of comminuted Australian brown coal particles of about 28 mesh and below are slurried in the mixed oil comprised of 210 gr. coal oil (bp. 180° C.-350° C.) and 90 gr. petroleum oil (fuel oil C) in a 1 l autoclave with an agitator. 4. gr. hydrogen is introduced into the autoclave to produce a pressure of 60 Kg/cm$^2$. The contents of the autoclave are heated to 410° C. by a heater with agitation and kept at the same temperature for 60 minutes. After cooling, the contents are discharged, the volume and the components of the gas produced are measured, the liquified matter is separated from minerals and unreacted residue by filtration and the liquid phase is distilled at a pressure of 10 mmHg abs. and a temperature of 240° C. in a vacuum distillation apparatus. Gaseous hydrocarbon, light oil and heavy oil are recovered, and 107 gr. of reformed coal is obtained. The yield of product, the composition of the reformed coal and of the gas are shown in the table below.

TABLE VI

| Yield of Product (gr.) | | | | | Content of Impurities of the Reformed Coal (%) | |
|---|---|---|---|---|---|---|
| Gas | Light Oil | Heavy Oil | Reformed Coal | Residue | Ash | Sulphur |
| 24 | 14 | 215 | 107 | 44 | 0.1 | 0.2 |

| Components of the Gas (Vol.%) | | | | | | | | |
|---|---|---|---|---|---|---|---|---|
| $CO_2$ | CnHm | $O_2$ | CO | $C_2H_6$ | $CH_4$ | $N_2$ | $H_2S$ | $H_2$ |
| 11.9 | 0.1 | 0 | 1.7 | 2.6 | 10.8 | 0.9 | 0.3 | 71.7 |

EXAMPLE 7

100 gr. of comminuted coal particles of about 28 mesh and below (Miike 62 Fun) are slurried in a mixed oil comprised of 270 gr. coal oil (bp. 180° C.-350° C.) and 30 gr. petroleum oil (Fuel Oil C) in a 1 l autoclave with an agitator. 4 gr. hydrogen is introduced into the autoclave to produce a pressure of 60 Kg/cm$^2$. The contents of the autoclave are heated to 430° C. by a heater with agitation and kept at the same temperature for 60 minutes. After cooling, the contents are discharged, the volume and the components of the gas produced are measured, the liquified matter is separated from minerals and unreacted residue by filtration and the liquid pahse is distilled at a pressure of 10 mmHg abs. and a temperature of 230° C. in a vacuum distillation apparatus. Gaseous hydrocarbon, light oil and heavy oil are recovered, and 84 gr. of reformed coal is obtained. The yield of product, the composition of the reformed coal and of the gas are shown in the table below.

TABLE VII

| Yield of Product (gr.) | | | | Content of Impurities of the Reformed Coal (%) | | |
|---|---|---|---|---|---|---|
| Gas | Light Oil | Heavy Oil | Reformed Coal | Residue | Ash | Sulphur |
| 5 | 10 | 271 | 84 | 34 | 0.1> | 0.7 |

| Components of the Gas (Vol.%) | | | | | | | | |
|---|---|---|---|---|---|---|---|---|
| $CO_2$ | CnHm | $O_2$ | CO | $C_2H_6$ | $CH_4$ | $N_2$ | $H_2S$ | $H_2$ |
| 0.3 | 0.2 | 0 | 0.6 | 1.3 | 8.9 | 0.6 | 1.3 | 86.8 |

EXAMPLE 8

100 parts (by weight) of dryed and crushed coal (Miike 62 Fun) are slurried by agitation in a mixed oil which comprises 210 parts (by weight) of the heavy oil (bp. 150° C.-500° C.) from the distillation apparatus mentioned below and 90 parts (by weight) of petroleum oil (Fuel Oil C with 4% sulphur) in a slurry tank. The slurried paste is introduced into a reaction apparatus at a hydrogen pressure of 60 Kg/cm$^2$ by passing through a heater in which the paste is heated to 410° C. The hydrogen used hereof is the recirculated hydrogen from the reforming apparatus and/or refining apparatus mentioned below. A product is separated into a gas phase and a liquid phase, with the gas phase being used as a recycled gas containing hydrogen after acidic gas was removed in a refining stage. The liquid phase is introduced into a distillation apparatus after removing unreacted residues and minerals (35 parts by weight) by filtration. 130 parts (by weight) of reformed coal is obtained as a bottoms product from the distillation, which also produces a gaseous hydrocarbon fraction, a light oil fraction and a heavy oil fraction. The heavy oil produced as a fraction of higher than about 150° C. is returned to the slurry tank, whereas the light oil and gaseous hydrocarbon produced are used as a supply of hydrogen after being reformed to hydrogen in a reforming apparatus. The weight of hydrogen consumed is 2 parts (by weight). The ash content of the reformed coal is less than 0.1%, and the sulphur content of the reformed coal is less than 0.8%.

What is claimed is:

1. In a process for manufacturing reformed coal which comprises the steps of (a) forming a slurry of coal in an oil; (b) subjecting the coal and oil slurry to hydrogenation conditions sufficient to depolymerize the coal; (c) separating a substantially liquified coal solution from the product of said hydrogenation; and (d) distilling said liquified coal solution at distillation conditions sufficient for distilling a heavy oil distillate therefrom and for recovering a reformed coal as a distillation bottoms product the improvement which comprises said slurry forming step (a) which includes the step of forming a mixed oil by adding an amount of 1 to 10 parts by weight of a coal oil having a boiling point higher than about 150° C to one part by weight of a petroleum oil which is a heavy fuel oil.

2. The process according to claim 1, further comprising the steps of recovering hydrocarbon components boiling at a temperature less than about 150° C. from said distillation step, subjecting said components to reforming conditions to produce hydrogen, and supplying said hydrogen as at least part of the hydrogen required for said hydrogenation step.

3. The process according to claim 1, wherein the ratio of coal added to said mixed oil (by weight) is between about 1:1 and 1:6.

4. The process according to claim 1, wherein the coal comprises particles of about 28 mesh and smaller.

5. The process according to claim 1, wherein the coal comprises particles of from about 2 mm to 100 mm in diameter.

6. The process according to claim 1, wherein said hydrogenation conditions comprise a hydrogen pressure of between about 3 kg/cm$^2$ and 150 kg/cm$^2$, a temperature of between about 350° C. and 500° C. and a residence time of between about 10 to 120 minutes.

7. The process according to claim 1, wherein the ratio of said coal oil and said heavy fuel oil (by weight) is between about 10:1 and 5:1.

8. The process according to claim 1, wherein the ratio of coal added to said mixed oil (by weight) is between about 1:1.2 and 1:3.

9. The process according to claim 1, wherein said hydrogenation conditions comprise a hydrogen pressure of between about 40 kg/cm$^2$ and 100 kg/cm$^2$, a temperature of 380 - 480° C. and a residence time of 30–90 minutes.

10. The process according to claim 1, further comprising the step of recycling to said slurry forming step a solvent having a boiling point higher than about 150° C. which is recovered from said distillation step as at least part of said coal oil.

11. The process according to claim 10, further comprising the step of hydrogenating said recovered solvent before said recycle step.

12. The process according to claim 10, wherein said recovered solvent is recycled to the slurry forming step without prior hydrogenating.

* * * * *